United States Patent [19]

Raasch et al.

[11] 4,120,140

[45] Oct. 17, 1978

[54] METHOD AND DEVICE FOR JOINING A THREAD

[75] Inventors: Hans Raasch; Hans Grecksch, both of Mönchengladbach, Germany

[73] Assignee: W. Schlafhorst & Co., Mönchengladbach, Germany

[21] Appl. No.: 795,736

[22] Filed: May 11, 1977

[30] Foreign Application Priority Data

May 11, 1976 [DE] Fed. Rep. of Germany ..... 2620805

[51] Int. Cl.[2] ..... D01H 15/00

[52] U.S. Cl. ..... 57/34 R; 57/58.89; 57/156

[58] Field of Search ..... 57/58.89, 34 R, 156

[56] References Cited

U.S. PATENT DOCUMENTS

| | | | |
|---|---|---|---|
| 3,695,017 | 10/1972 | Hori et al. | 57/34 R |
| 3,810,352 | 5/1974 | Muyojaki et al. | 57/34 R |
| 3,892,062 | 7/1975 | Stablecker et al. | 57/34 R |
| 3,962,855 | 6/1976 | Stablecker | 57/34 R |

*Primary Examiner*—Charles Gorenstein
*Attorney, Agent, or Firm*—Herbert L. Lerner

[57] ABSTRACT

Method of joining a thread of a take-up coil in a spinning rotor of a spinning station of a rotor spinning machine having a normal travel course therethrough from the spinning rotor to the take-up coil for a thread that has spun therein and having a thread draw-off device and a thread guide disposed in the normal travel course, the joining being effected by means of a traveling joining device having a thread draw-off device for drawing off a thread end from the take-up coil and having a thread delivery device for transfering the drawn-off thread end to the spinning rotor of the spinning station, the method includes the steps of guiding a thread back from the take-up coil to the spinning rotor through the thread draw-off device of the joining device, that has been switched to reverse operation, and through the thread draw-off device of the spinning station that has been switched to idling operation, switching the thread draw-off device of the joining device to forward operation at an instant at which the thread is joined, switching on the thread draw-off device of the spinning station at an instant at which the thread draw-off devices of both the spinning station and the joining device are operating in synchronism, removing the thread from the thread draw-off device of the joining device by means of the thread delivering device and transfering the thread thereby, at a winding speed of the take-up coil that is increased over the normal winding speed thereof, to the normal travel course of the thread and to the thread guide in the spinning station against the action of a restoring force and device for performing the method.

5 Claims, 6 Drawing Figures

METHOD AND DEVICE FOR JOINING A THREAD

The invention relates to a method and a device for joining a thread and, more particularly, for joining such a thread that is fed from a take-up coil into the spinning rotor of a spinning station of a rotor spinning machine by means of a traveling joining device.

The traveling joining device has a special thread draw-off device or the purpose of the joining operation. The thread is returned or rerouted form a normal travel direction and redrawn in such a manner that it passes around the draw-off roller of this joining device and reconducted from there to the draw-off tube of the spinning rotor. After the joining operation, the draw-off roller is switched over from backward rotation to forward rotation. Then, the thread is drawn off at constant normal draw-off speed. If the thread is then to be transfered into the normal thread travel course of the spinning station, an additional thread length becomes free. Disturbances accordingly occur. Either the thread must only yet be taken over by the thread draw-off device of the spinning station after the thread has left the thread draw-off device of the joining device, or the thread is, in fact, very rapidly taken over by the thread draw-off device of the spinning station, and the take-up coil is however, not able to take up so rapidly the additionally freed length of thread.

In the first case, the thread is spun more thickly because it is temporarily withdrawn from the spinning rotor at reduced speed, and in the second case, it is wound without tension loosely on the take-up coil.

It is accordingly an object of the invention to provide a method and device for joining a thread whereby the joining of a thread fed into a spinning rotor is effected without forming thickened regions, with uniform thread tension and without disrupting the wind-up process.

With the foregoing and other objects in view, there is provided, in accordance with the invention, a method of joining a thread of a take-up coil in a spinning rotor of a spinning station of a rotor spinning machine having a normal travel course therethrough from the spinning rotor to the take-up coil for a thread that has been spun therein and having a thread draw-off device and a thread guide disposed in the normal travel course, the joining being effected by means of a traveling joining device having a thread draw-off device for drawing off a thread end from the take-up coil and having a thread delivery device for transfering the drawn-off thread end to the spinning rotor of the spinning station, the method comprising the steps of guiding a thread back from the take-up coil to the spinning rotor through the thread draw-off device of the joining device, that has been switched to reverse operation, and through the thread draw-off device of the spinning station that has been switched to idling operation, switching the thread draw-off device of the joining device to forward operation at an instant at which the thread is joined, switching on the thread draw-off device of the spinning station at an instant at which the thread draw-off devices of both the spinning station and the joining device are operating in synchronism, removing the thread from the thread draw-off device of the joining device by means of the thread delivering device and transfering the thread thereby, at a winding speed of the take-up coil that is increased over the normal winding speed thereof, to the normal travel course of the thread and to the thread guide in the spinning station against the action of a restoring force. The winding speed of the take-up coil is then again advantageously brought to a normal value for the spinning operation, the moment the thread delivering device has brought the thread into the normal thread travel course.

In accordance with another aspect of the invention, there is provided a device for performing the foregoing method of joining a thread of a take-up coil in a spinning rotor of a spinning station of a rotor spinning machine having a normal travel course therethrough from the spinning rotor to the take-up coil for a thread that has been spun therein and having a thread draw-off device and a thread guide disposed in the normal travel course, comprising a carriage, a thread draw-off device mounted on said carriage, means mounted on said carriage for guiding a thread back from the take-up coil to the spinning rotor through said thread draw-off device mounted on said carriage, that has been switched to reverse operation, and through the thread draw-off device of the spinning station, that has been switched to idling operation, and thread delivering means mounted on said carriage for removing the thread from said thread draw-off device mounted on said carriage and, against an opposing restoring force, transfering the thread, after joining thereof, to the normal travel course of the thread in the spinning station.

In accordance with another feature of the invention, the device includes means on the carriage for driving the take-up coil, during transfer thereof by the thread delivering means, at a greater speed than that at which it is driven during normal spinning operation of the spinning station.

In accordance with a further feature of the invention, the thread delivering means comprise a member disposed on the carriage and guidable, during transfer of the thread, into the normal travel course of the thread in the spinning station and laterally beneath an end of the take-up coil.

In accordance with a concomitant feature of the invention, the guiding means mounted on the carriage comprise a thread regulator carrying a thread lifter which is controllable by movement of the thread regulator, the thread lifter being actuatable for inserting the thread into the thread draw-off device of the spinning station after transfer of the thread.

The advantages achieved with the method and device of the invention are especially that, after the joining operation, troublefree wind-up of the joined thread is able to be effected. This has especially advantageous consequences with wind-up devices for conical coils because, during the thread transfer, the thread storages for equalizing varying winding speeds cannot yet operate, and the novel thread delivering device according to the invention, in this case, also assumes the function of a thread storage.

Other features which are considered as characteristic for the invention are set forth in the appended claims.

Although the invention is illustrated and described herein as embodied in a method and device for joining a thread, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
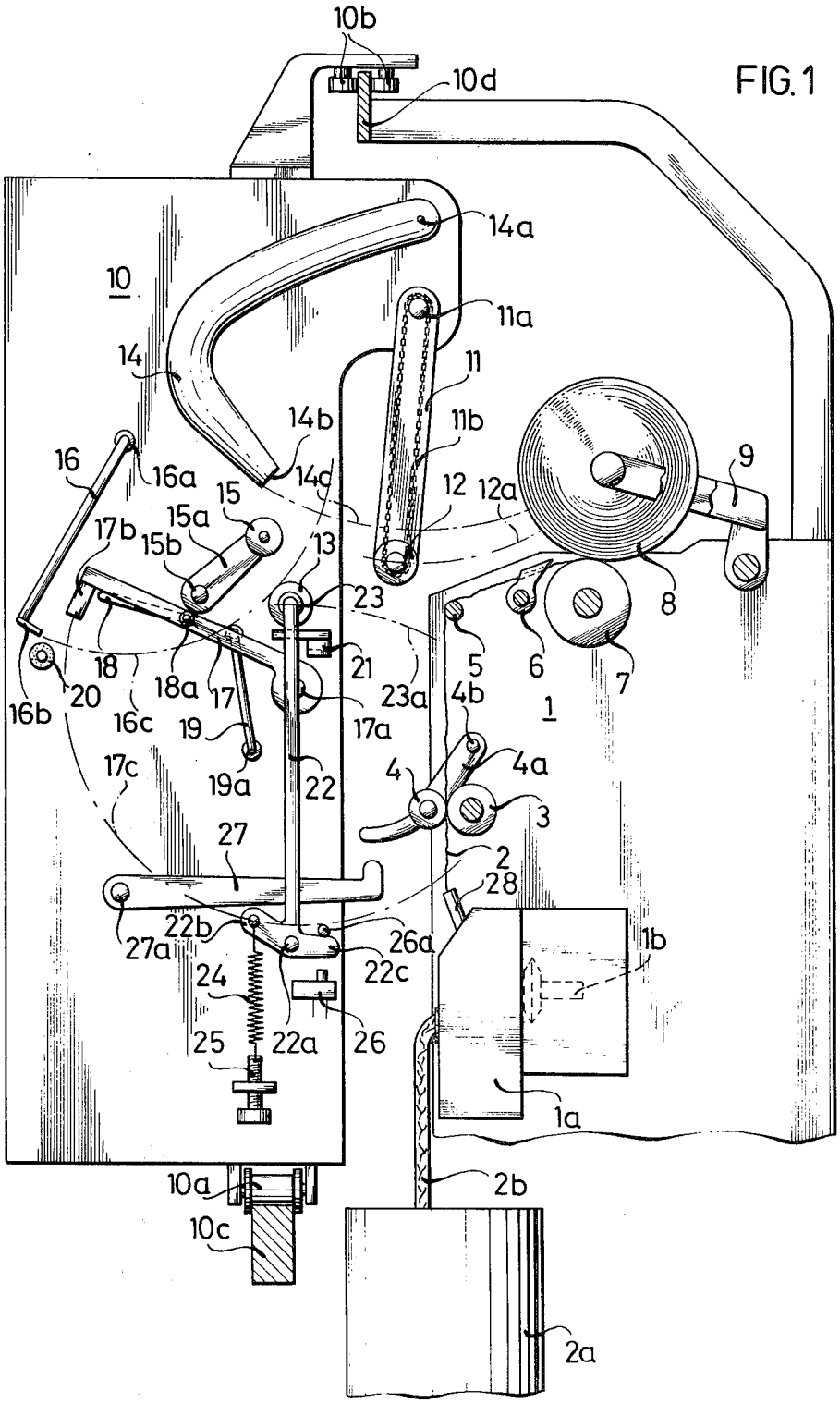
FIG. 1 is a side elevational view of a spinning station and a thread-piecing or joining device constructed in accordance with the invention.

Referring now to the drawings and first, particularly to FIG. 1 thereof, there is shown a spinning station 1 having a rotor spinning device 1*a* with a spinning rotor 1*b*.

In normal operation, the spun thread 2 is guided by a thread draw-off device formed of a draw-off roller 3 and a clamping roller 4. The thread 2 is withdrawn by the thread draw-off device at constant speed out of the rotor spinning device 1*a*. The thread 2 runs from the draw-off roller 3 over a deflecting or guide rod 5, through a thread guide 6 and over a winding cylinder 7 onto a take-up coil 8. The take-up coil 8 is driven at constant speed due to friction by the winding roller 7. The take-up coil 8 is mounted in a coil frame 9.

In front of the winding station 1 is a thread-joining device 10 which is capable of traveling on rails 10*c*, 10*d* by means of rollers 10*a*, 10*b*. The joining device 10 has a drive arm 11 which is rotatable about a pivot 11*a*. A drive roller 12 rotatably mounted at the end of the drive arm 11 and drivable by a chain drive 11*b* is pivotable along a circular arc 12*a*. The drive roller 12 is drivable in opposite rotary directions by means of the chain drive 11*b*.

An additional thread draw-off device formed of a draw-off roller 13 and a clamping roller 15 is located on the thread-joining device 10. The clamping roller 15 is seated at the end of a lever 15*a*, which is pivotable about a pivot 15*b*. The drive roller 12 and the draw-off roller 13 are drivable in synchronism with equal peripheral speed.

A suction tube 14 is rotatably suspended at an articulating joint 14*a* so that the suction nozzle 14*b* thereof is pivotable along a circular arc 14*c*. A thread drawing device 16 is pivotable about a pivot point 16*a* and has a thread gripper 16*b* which describes a circular arc 16*c* when the thread gripper 16 is swung about the pivot 16*a*.

A grinding disc 20 serves for the hereinafter further explained processing of the thread that is to be returned. Also additionally provided is a thread regulator 17 pivotable about an articulating joint 17*a* and carrying a pivot 18*a* to which a thread lifter 18 is pivotally fastened. The thread lifter 18 is controllable by an articulatingly fastened couple 19. The couple 19 is articulatingly connected in the pivot 19*a* with the housing of the thread-joining device 10. The clamp 17*b* of the thread regulator 17 is swingable along a circular arc 17*c*.

Figure 5:
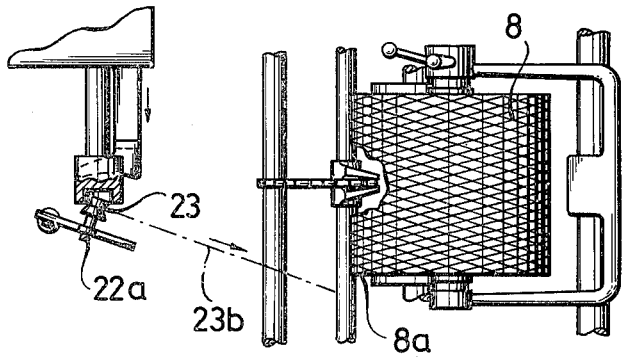
FIG. 5 is a fragmentary plan view of the spinning station and thread-joining device of FIGS. 1 to 4.

Below the draw-off roller 13 is a throwing device 21 which is displaceable in a direction perpendicular to the plane of the drawing of FIG. 1, for example. The throwing device 21 serves, at the proper time, for throwing a thread located on the drawoff roller 13 onto a roller 23 of a thread delivering device 22 (note FIG. 5).

The thread delivering device 22 is pivotable about an articulating joint 22*a*. It has a lever 22*b*, on which one end of a return spring 24 is suspended. The other end of the return spring 24 is articulatingly fastened to a set screw 25. The spring force of the return spring 24 can be adjusted by means of the set screw 25. A roller 23 of the thread delivering device 22 is swingable along a circular arc 23*a*. If the thread delivering device 22 is swung into the other end position thereof, the effective length of the lever arm of the lever 22*b* changes so that the effect of the return spring 24 on the thread delivering device 22 becomes smaller. The instant the thread delivering device 22 attains the other end position thereof, the additional lever 22*c* thereof actuates a switch 26.

A stop pin 26*a* prevents an unduly wide return swing of the thread delivery device 22 under the effect of the return spring 24. It is apparent from FIG. 5, that the articulating joint 22*a* is set at an inclination so that the roller 23 can swing in direction of the arrow 23*b* under the coil end 8*a* of the take-up coil 8.

Figure 6:
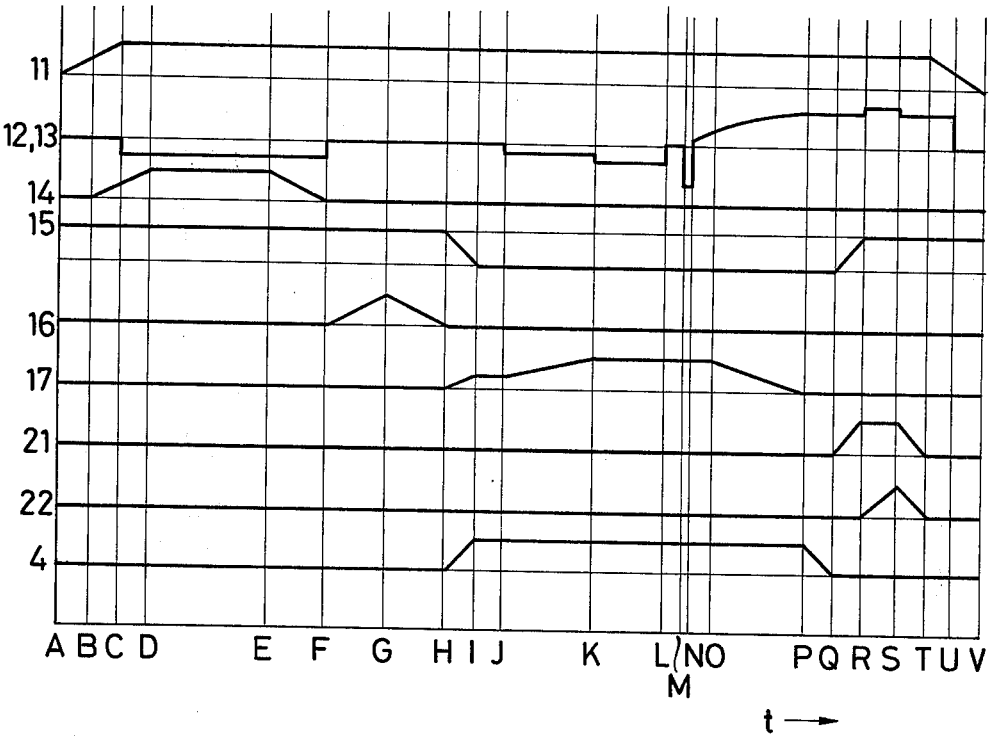
FIG. 6 is a movement and control diagram or the joining operation.

The displacement and control diagram of FIG. 6 as well as the views in FIGS. 1 to 5 should aid in an understanding of the thread-joining operation. In FIG. 6, the abscissa represents the time t, and the ordinate, the displacement and control of the parts 4, 11 to 17, 21 and 22 to be controlled, for example, in accordance with a sequential control plan.

FIG. 1 shows the disposition of all of the parts during undisrupted spinning operation. Slubbing or a silver 2*b* is fed from a can 2*a* to the rotor spinning device 1*a*. The thread 2 is formed in the rotor 1*b*, and is guided through a draw-off tube 28 and through the draw-off device 3, 4 at constant speed. A lifter 27, which is swingable about a pivot 27*a* and which serves for lifting a clamping roller 4 of the draw-off device 3, 4 and which is fastened to a lever 4*a* and is swingable about a pivot 4*b* is disposed in neutral or rest position. Upon the occurrence of an interruption in operation of the spinning station, which necessitates a joining operation again, the scene is the same as in FIG. 1 with the difference that the thread 2 is missing and the thread end has run up onto the take-up coil 8. The feed of the slubbing or sliver 2*b* is additionally blocked.

Figure 2:
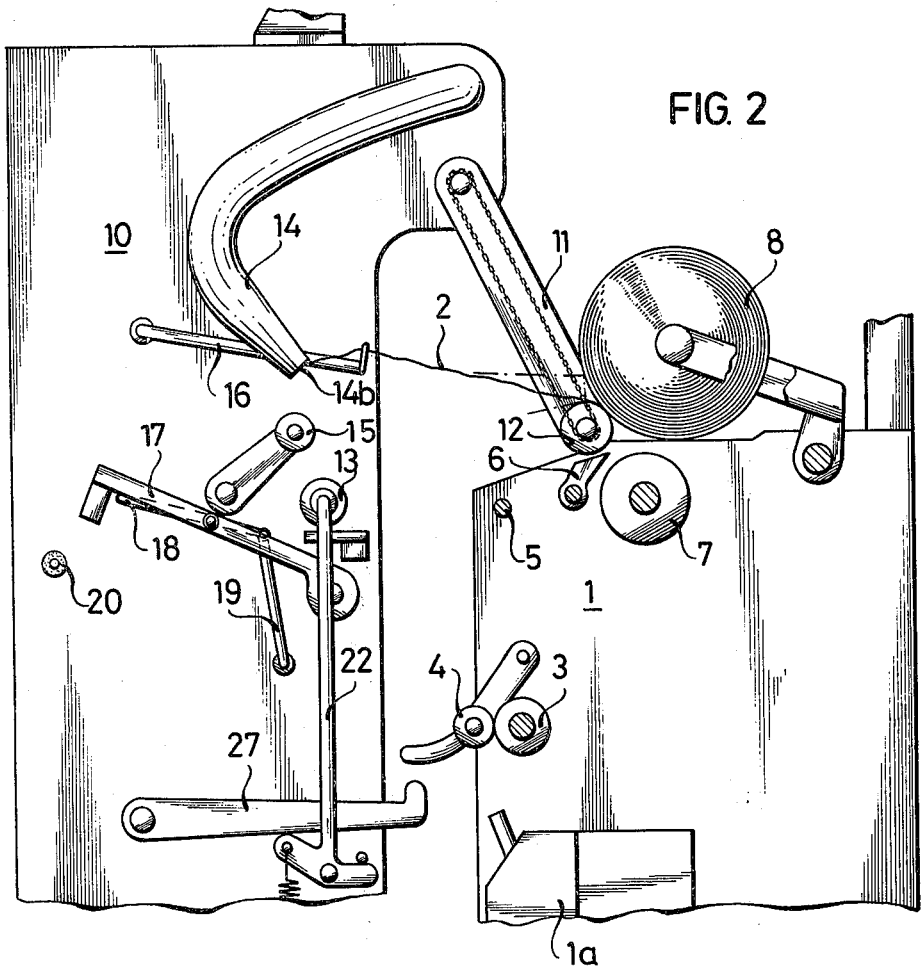
FIGS. 2 to 4 are fragmentary views of FIG. 1 showing the spinning station and the thread-joining device in various modes of operation thereof at various instants of the joining operation.

At a command for starting up the joining operation, which is given at the instant A according to FIG. 6, the drive arm 11 swings toward the take-up coil 8. Then, at the instant B, the suction arm 14 also begins to swing toward the take-up coil 8. The moment the drive arm 11 at the instant C has reached the take-up coil 8, the drive roller 12 of the drive arm 11 begins to rotate backwards. It accordingly lifts the take-up coil 8 away from the winding cylinder 7 and rotates it in a direction opposite the wind-up direction. Simultaneously, the draw-off roller 13 is also switched to backwards rotation. At the instant D, the suction arm 14 has gotten so near to the take-up coil 8 that the suction nozzle 14*b* is disposed closely in front of the surface of the coil 8. For the period up to the instant E, the thread is then sought for on the surface of the coil 8 and is sucked in by the suction nozzle 14*b*. Thereafter, the suction arm 14 swings back again until the instant F and entrains the thread 2 therewith, as shown in FIG. 2. Simultaneously at the instant F, the drive roller 12 and the draw-off roller 13 are switched off or disconnected. The draw-off roller 13 had heretofore as yet no contact with the thread and rotated only because it is turned on and off in synchronism with the drive roller 12.

Figure 3:
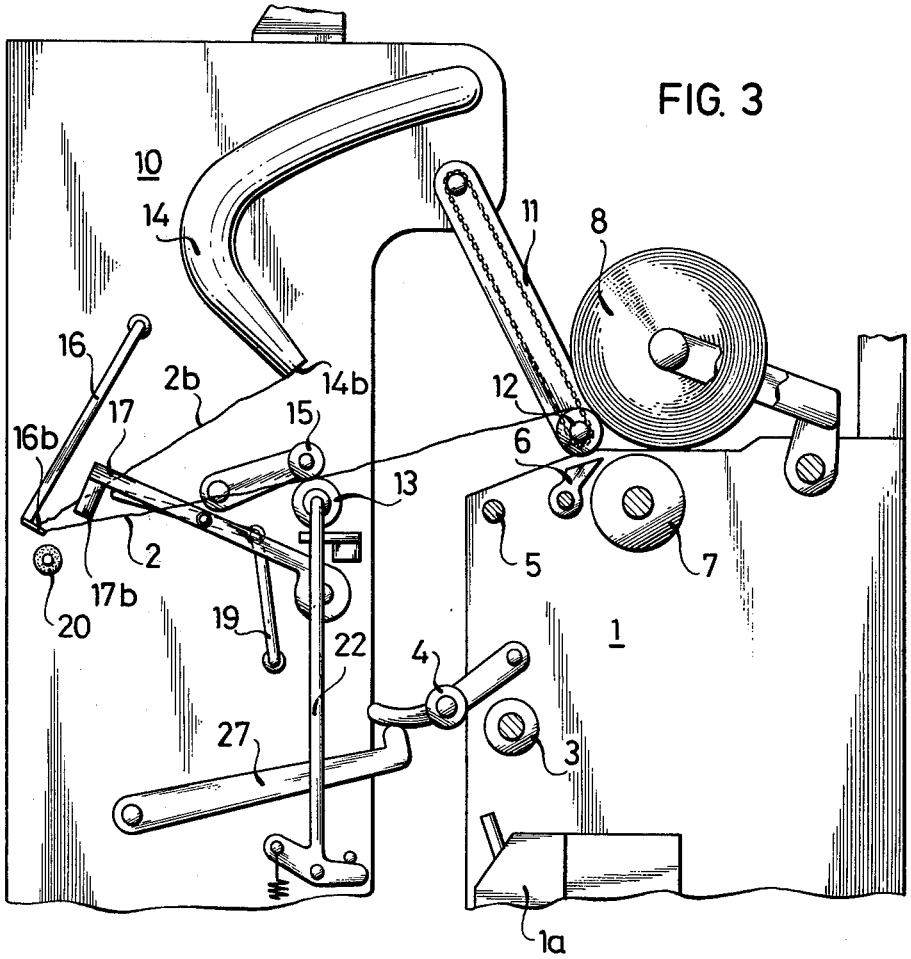
Figure 4:
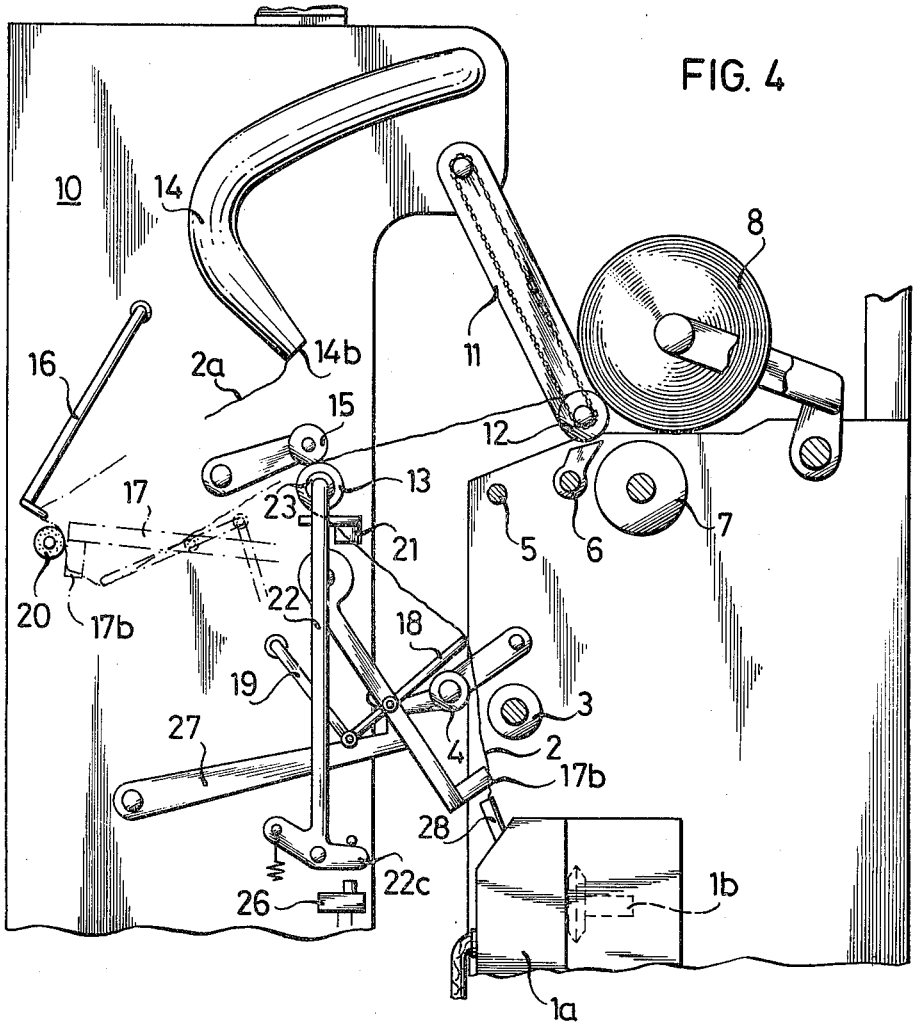

From the instant F to the instant G, the thread drawing device 16 swings upwardly seizes the thread 2, swings back again until the instant H and draws out the loop of the thread 2 shown in FIG. 3. The thread 2, at that instant, extends from the take-up coil 8, between and through the clamping roller 15 and the draw-off roller 13 of the thread draw-off device to the thread gripper 16*b*. From the latter, the thread end 2*b* extends to and into the suction nozzle 14*b*. At the instant H, the clamping roller 15 is swung against the draw-off roller 13, and the thread regulator 17 is set in motion. Simultaneously therewith, the clamping roller 4 is lifted due to actuation of the lifter 27 by the draw-off roller 3, as shown in FIG. 3. At the instant I, the thread 2 is clamped between the draw-off roller 13, which is still stationary, and the clamping roller 15. The thread draw-off device 3, 4 of the spinning station is then completely opened. The thread regulator 17 is swung slightly downwardly in the interim and, in fact, so far that the clamp 17*b* is disposed in front of the grinding disc 20. The grinding disc 20 severs the thread and makes the new thread end ready for the joining operation by loosening the fibers thereof and by forming or sharpening a point thereat. The old thread end 2*a* is sucked in by the suction nozzle 14*b* and removed.

At the instant J, the drive roller 12 and the draw-off roller 13 are turned on for slow reverse rotation. Simultaneously, the thread regulator 17 begins to swing farther downwardly along the circular path 17*c*. At the instant K, the last-mentioned swinging movement of the thread regulator 17 is terminated, as is apparent from FIG. 4. The clamp 17*b* of the thread regulator 17 is then disposed in front of the opening of the draw-off tube 28 of the rotor spinning device 1*a*. Controlled by the couple 19, the thread lifter 18 has, in the interim, been disposed transversely to the thread regulator 17 and has placed the thread 2 into the opened thread draw-off device 3, 4 of the spinning station. At the instant K, the clamp 17*b* is opened. Simultaneously therewith, the thread end is sucked into the draw-off tube 28. At the same instant, the drive roller 12 and the draw-off roller 13 are switched to a somewhat faster reverse rotation.

At the instant L, the thread end has virtually reached the rotor groove or flute of the spinning rotor 1*b*. The drive roller 12 and the draw-off roller 13 are stopped or held in check between the instants L and M, in order, immediately thereafter, between the instants M and N, to feed back a remainder thread portion into the spinning rotor 1*b*, whereby the joining operation proper then takes place. At the instant N, the direction of rotation of the drive roller 12 and the draw-off roller 13 is reversed and then increased rapidly at high speed until it attains a predetermined operating speed of the thread draw-off. At the instant O, the thread regulator 17 begins to swing back. This movement ends at the instant P. At the same instant the operating speed of the thread draw-off is attained i.e. the draw-off rollers 3 and 13 have equal peripheral speed. The draw-off roller 3 rotates continuously at normal thread draw-off speed.

Between the instants P and Q, the lifter 27 is again redrawn so that the clamping roller 4 is placed against the draw-off roller 3.

The transfer of the thread 2 to the thread guide 6 can then be effected. For that purpose, at the instant Q, the clamping roller 15 is lifted from the draw-off roller 13, initially, and the throwing member 21 is set into operation. The thrower 21 forces the thread 2 laterally downwardly from the draw-off roller 13 so that it slides onto the roller 23 of the thread delivering device 22. When that has occurred at the instant R, the thread delivering device 22 begins to swing obliquely or at an inclination in direction toward the spinning station 1. This movement ends at the instant S. Between the instants R and S, the drive roller 12 and the draw-off roller 13 are switched to rapid forward rotation. This is necessary so that, with unvarying or slightly increased thread tension, the take-up coil 8 can take up the thread length that has additionally been freed through the swinging of the thread delivering device 22. The draw-off roller 13 then has actually no function any more, and therefore only follows emptily because, in the interest of simplicity, it is connected in synchronism with the drive roller. The swinging of the thread delivery device 22 occurs in the instant case under the action of the thread tension against the force of the adjustable return spring 24. The return spring 24 is so suspended that the force components acting in deflecting direction become smaller with increasing deflection of the thread delivery device 22. This is advantageous because the looping angle of the thread and therewith also the effective force component of the thread tension also becomes smaller with increasing deflection. In the end or terminal position of the thread delivery device 22, the lever 22*c* actuates the switch 26 at the instant S. The switch 26 switches the drive roller 12 and the draw-off roller 13 on again to the normal thread draw-off speed. Since the thread delivery device 22 deflects the thread 2 obliquely under the coil end 8*a* (FIG. 5), the thread 2 initially slides laterally away from the drive roller 12 and is seized by the thread guide 6 at the instant S and is drawn off laterally from the roller 23 of the thread delivery device 22.

After the thread delivery or transfer has ended, the thread delivery device 22 swings again into the starting position thereof under the action of the return spring 24. When it has occurred at the instant T, the drive arm 11 also begins to swing back. During the swinging movement of the drive arm 11, after the take-up coil 8 again lies on the winding cylinder 7, the drive roller 12 and the draw-off roller 13 are switched off. The moment the drive arm 11 has attained the neutral or rest position thereof according to FIG. 1, at the instant V, the control program has run out.

The program switchgear is contained in the thread-joining device 10 and is not otherwise illustrated. The program switchgear contemplated for the invention can, for example, be of conventional type, such as an electromechanical program switchgear operating with cam discs.

There are claimed:

1. Method of joining a thread of a take-up coil at a spinning station of a rotor spinning machine having a normal travel course therethrough from the spinning rotor to the take-up coil for a thread that has been spun therein and having a thread draw-off device and a thread guide disposed in the normal travel course, the joining being effected by means of a traveling joining device having a thread draw-off device for drawing off a thread end from the take-up coil and having a thread delivery device for transferring the drawn-off thread end to the spinning rotor of the spinning station, the method comprising the steps of guiding a thread back from the take-up coil to the spinning rotor through the thread draw-off device of the joining device, which has been switched to reverse operation, and through the thread draw-off device of the spinning station which has been switched to idling operation, switching the thread draw-off device of the joining device to forward operation at an instant at which the thread is joined, switching on the thread draw-off device of the spinning station at an instant at which the thread draw-off devices of both the spinning station and the joining device are operating together, removing the thread from the thread draw-off device of the joining device by means of the thread delivery device and transfering the thread thereby to the normal travel course of the thread and to the thread guide in the spinning station against the action of a restoring force, and rotating the take-up coil during said transfer at a speed that is increased over the normal winding speed.

2. Device for performing a method of joining a thread of a take-up coil of a spinning station of a rotor spinning machine having a normal travel course therethrough from the spinning rotor to the take-up coil for a thread that has been spun therein and having a thread draw-off device and a thread guide disposed in the normal travel course, comprising a carriage, a thread draw-off device mounted on said carriage, means mounted on said carriage for guiding a thread back from the take-up coil to the spinning rotor through said thread draw-off device mounted on said carriage, said draw-off device having been switched to reverse operation, and through the thread draw-off device of the spinning station, which has been switched to idling operation, and thread delivering means mounted on said carriage for removing the thread from said thread draw-off device mounted on said carriage and, against an opposing restoring force, transfering the thread, after joining thereof, to the normal travel course of the thread in the spinning station.

3. Device according to claim 2 including means on said carriage for driving the take-up coil, during transfer of the thread by said thread delivering means, at a greater speed than that at which it is driven during normal spinning operation of the spinning station.

4. Device according to claim 2 wherein said thread delivering means comprise a member disposed on said carriage and guidable, during transfer of the thread, into the normal travel course of the thread in the spinning station and laterally beneath an end of the take-up coil.

5. Device according to claim 2 wherein said guiding means mounted on said carriage comprise a thread regulator carrying a thread lifter which is controllable by movement of said thread regulator, said thread lifter being actuatable for inserting the thread into the thread draw-off device of the spinning station after transfer of the thread.

* * * * *